US007518477B2

(12) United States Patent
Martin et al.

(10) Patent No.: US 7,518,477 B2
(45) Date of Patent: Apr. 14, 2009

(54) ELECTROMECHANICAL CIRCUIT BREAKER AND METHOD OF BREAKING THE CURRENT IN SAID ELECTROMECHANICAL CIRCUIT BREAKER

(75) Inventors: Serge Martin, Meyrin (CH); Henri Duffour, Fé ternes (FR); Raphaël Kissling, Chatelaine (CH); Bjorn Fischer, Eysins (CH)

(73) Assignee: Secheron S.A., Satigny (CH)

( * ) Notice: Subject to any disclaimer, the term of this patent is extended or adjusted under 35 U.S.C. 154(b) by 0 days.

(21) Appl. No.: 11/917,783

(22) PCT Filed: Jun. 12, 2006

(86) PCT No.: PCT/IB2006/001551

§ 371 (c)(1),
(2), (4) Date: Feb. 21, 2008

(87) PCT Pub. No.: WO2006/134452

PCT Pub. Date: Dec. 21, 2006

(65) Prior Publication Data

US 2008/0197113 A1 Aug. 21, 2008

(30) Foreign Application Priority Data

Jun. 16, 2005 (WO) ..... PCT/EP2005/006472

(51) Int. Cl.
*H01H 9/44* (2006.01)

(52) U.S. Cl. ..... 335/201; 218/22; 218/36; 218/40

(58) Field of Classification Search ..... 335/201; 218/22–42

See application file for complete search history.

(56) References Cited

U.S. PATENT DOCUMENTS 2,515,596 A 7/1950 Griffes
2,625,627 A 1/1953 Grepe
4,302,644 A 11/1981 Arvisenet et al.
4,539,451 A * 9/1985 Mori et al. ..... 218/22

FOREIGN PATENT DOCUMENTS

DE 10 73 576 B 1/1960

OTHER PUBLICATIONS

International Search Report of PCT/IB2006/001551 filed Jun. 12, 2006, date of mailing Aug. 29, 2006.

* cited by examiner

*Primary Examiner*—Ramon M Barrera
(74) *Attorney, Agent, or Firm*—Young & Thompson

(57) ABSTRACT

The electromechanical circuit breaker is intended to establish and break the current in a main circuit (3, 4) and comprises a fixed contact element (5) and a moving contact element (6) which in a first position are in electrical contact with each other for carrying the current of the main circuit (3, 4). Said moving contact element (6) is adapted to be displaced to a second position in which it is separated from the fixed contact element (5) so that the current in the main circuit is cut off. The circuit breaker is provided with a blow-out device (2) comprising a magnetising coil (8) traversed by a magnetising current for producing a magnetic field (26) adapted to drive an arc generated by the separation of said two contact elements (5, 6) into an arc extinction means. The blow-out device (2) comprises electrodes (12) electrically connected to the magnetising coil (8) and adapted to cooperate with said arc in such a manner that the latter generates said magnetising current in the magnetising coil (8). The magnetic field for driving the arc is generated by the action of said arc. Said electrodes (12) are located in such a relationship with said contact elements (5, 6) that the arc generated by the separation of said two contact elements is at least partially separated into a first arc (13*a*) between one contact element (5) and the electrodes (12) and a second arc (13*b*) between the electrodes (12) and the other contact element (6). Said first or second arc (13*a*, 13*b*) is set in parallel coupling with said magnetising coil (8) connected on one side to the electrodes (12) and on the other side to one of the contact elements (5, 6). These features allow to obtain high breaking efficiency and performances even when breaking smaller currents.

20 Claims, 7 Drawing Sheets

ELECTROMECHANICAL CIRCUIT BREAKER AND METHOD OF BREAKING THE CURRENT IN SAID ELECTROMECHANICAL CIRCUIT BREAKER

This invention relates to electromechanical circuit breakers especially but non-exclusively adapted for the protection of DC installations such as traction networks including rail vehicles. Such networks have typically a nominal voltage of 750 to 3000 V. The circuit breaker is for instance used for the interruption of heavy currents in case of a short circuit somewhere in the installation. It has, however, also numerous other industrial applications. Such known electromechanical circuit breakers are intended to establish and break the current in a main circuit and comprise a fixed contact element and a moving contact element which in a first position are in electrical contact with each other for carrying the current of the main circuit, said moving contact element being adapted to be displaced to a second position in which it is separated from the fixed contact element so that the current in the main circuit is cut off, the circuit breaker being provided with a blow-out device comprising a magnetising coil traversed by a magnetising current for producing a magnetic field adapted to drive an arc generated by the separation of said two contact elements into an arc extinction means, the blow-out device (2) comprising electrode means electrically connected to the magnetising coil and adapted to cooperate with said arc in such a manner that the latter generates said magnetising current in the magnetising coil, the magnetic field for driving the arc being generated by the action of said arc.

Circuit breakers, are today used in most of the feeding stations and rail vehicles in traction systems. These electromechanical circuit breakers comprise a fixed contact element co-operating with a movable contact element. Under normal conditions these elements are in contact with each other and current in a main circuit is conducted between the elements. When breaking the current the physical distance between these contact elements is increased by means of some type of electromechanical actuator which will create an electrical arc between the two contact elements.

In order to make the breaking of the current effective this electrical arc has to be extinguished. This is usually accomplished by making use of a so called arc-chute of a known type into which the arc is directed by a force related to the magnetic field generated by the main circuit. Inside this arc-chute the arc will be split up in a multitude of smaller arcs which will ultimately lead to the final break down of the conduction over the separated contact elements.

The electromagnetic force for displacing the arc into the arc-chute in a DC circuit breaker is in general a function of the square of the current value. There is a particular problem when the current to be interrupted is very low. In this case the generated force will not be sufficient to displace the arc into the arc-chute.

For this purpose, circuit breakers of this type are provided with a so-called blow-out device which can be of the electromagnetic type, which means that an electromagnetic force is used to drive the electrical arc into an arc extinguishing device such as an arc-chute.

In e.g. the U.S. Pat. No. 4,302,644 a solution is proposed according to which an electrical coil is connected in series with the contacts and is thus taking the full current of the breaker. In order to keep the volume of the arrangement within limits only a small number of turns can be used, which will limit the efficiency when breaking smaller currents.

It is known in the art that in some instances small current interruption can be much more demanding with regard to interruption performance than large current interruption.

One object of the present invention is to provide an improved design of a blow-out device for an electromechanical circuit breaker which eliminates the inconveniences of the known devices.

According to the invention this result is achieved by providing a blow-out device having the features according to the appended claim 1 and which is characterized by the fact that said electrode means are located in such a relationship with said contact elements, that the arc generated by the separation of said two contact elements is at least partially separated into a first arc between one contact element and the electrode means and a second arc between the electrode means and the other contact element, said first or second arc being set in parallel coupling with said magnetising coil connected on one side to the electrode means and on the other side to one of the contact elements.

These features allow to obtain a circuit-breaker having a high efficiency even when breaking smaller currents. Moreover, high solidity and longevity and a lower cost price can be obtained.

Favourably, the blow-out device is arranged in such a manner that current passing in the magnetising coil is smaller that the current passing in the first or second arc set in parallel coupling with the magnetising coil between the electrode means and the one of said contact elements.

It is thus possible to use a magnetising coil with a considerable number of turns, which allows to enhance the performance and the efficiency of the blow-out device even when breaking small currents.

In a advantageous embodiment, the moving contact element comprises a surface which is, in a predetermined position of the moving contact element, flush with a plane passing through the electrode(s) arranged on both sides of the trajectory of the moving contact element such that at least a part of the arc can jump over to the electrode(s) to form said first arc and from the electrode(s) to the movable contact element to form said second arc.

This arrangement allows to obtain a very precise and secure functioning of the circuit-breaker.

The blow-out device is favourably provided with a magnetising circuit comprising at least two arms each terminated by at least one pole piece, said magnetic field for driving the arc being generated at least partially between said pole pieces.

These feature allow to generate a magnetic field which particularly well adapted to drive the arc into the arc-chute, thus to obtain a high breaking performance and security.

The invention relates moreover to a method of breaking the current in an electromechanical circuit breaker intended to break the current in a main circuit and comprising a fixed contact element and a moving contact element which in a first position are in electrical contact with each other for carrying the current of the main circuit, said moving contact element being adapted to be displaced to a second position in which it is separated from the fixed contact element so that the current in the main circuit is cut off, an arc generated by the separation of said two contact elements being driven into arc extinction means by a blow-out device comprising a magnetising coil traversed by a magnetising current for creating a magnetic field adapted to drive said arc, the magnetic field for driving the are being generated by the action of the arc, the latter being forced to cooperate with electrode means electrically connected to the magnetising coil so as to generate said magnetising current in the magnetising coil for driving the arc into the arc extinction means, characterized by the fact that the arc generated by the separation of said two contact elements is at least partially separated into a first arc between one contact element and the electrode means and a second arc between the electrode means and the other contact element, said first or second arc being set in parallel coupling with said magnetising coil connected on one side to the electrode means and on the other side to one of the contact elements.

Other features, objects, uses and advantages of this invention will be apparent from the dependent claims and from the description which proceeds with reference to the accompanying drawings forming part thereof and wherein:

Figure 1:
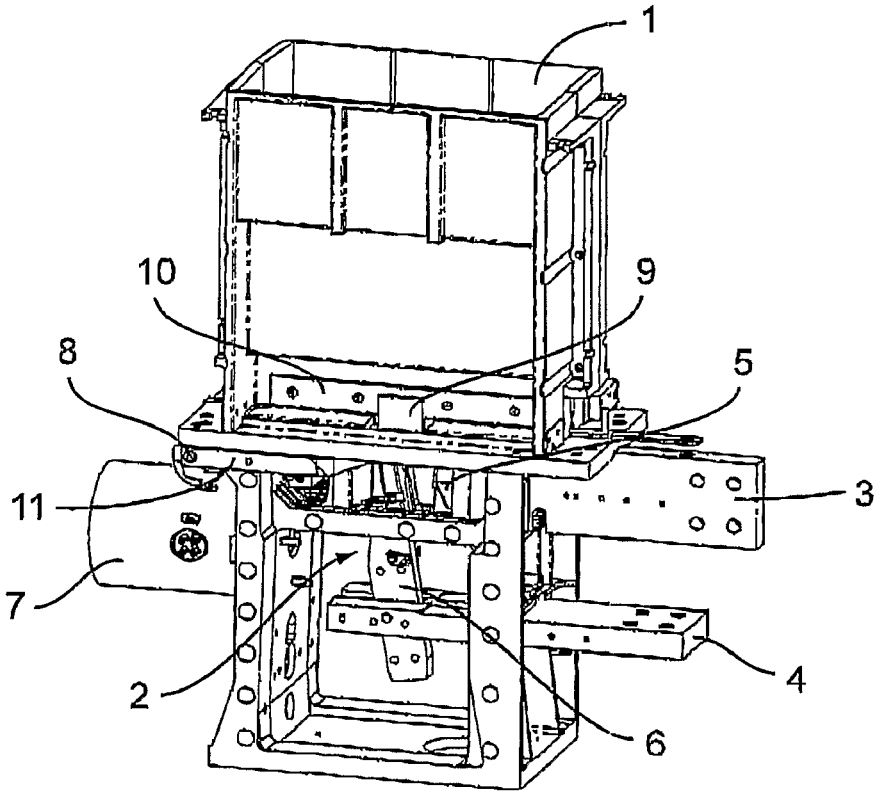
FIG. 1 shows a circuit breaker according to the invention with a blow-out device and an associated arc-chute.

FIG. 1 shows schematically and in a general way a circuit breaker according to the invention with a blow-out device 2 and an associated arc-chute 1. This arc-chute is of a conventional design and will not be further described in this context. The main current path passes through the contact bar 3 to a fixed mechanical contact element 5, through an associated moving mechanical contact element 6 and the contact bar 4. Under normal conditions these contact elements are in electrical contact with each other carrying the main current. The current through the mechanical contact elements could flow in either direction at the moment when the circuit breaker is activated.

The movement of the mechanical contact element 6 is controlled by means of a very fast actuator 7 creating the needed physical movement for opening the electrical contact by e.g. pulling the contact elements apart and increasing the distance between the elements.

A typical situation in which the circuit breaker is activated is when there for some reason appears a short circuit somewhere in the main circuit in which the circuit breaker is connected.

Such a short circuit could considerably increase the current over nominal values which could of course damage components and equipment in said main circuit.

In order to minimise the effect of such a short circuit it would therefore be of interest to completely break the current as quickly as possible which is thus accomplished by means of the circuit breaker.

The circuit breaker should, however, also be able to break smaller currents which could cause the bigger design problem.

Detection means (not shown) are e.g. arranged in the main circuit and aimed to detect conditions under which the main current should be cut off. Such a condition may consist in an increase of the current which could be the result of a short circuit. Co-operating control means (not shown) send a signal to the actuator 7 of the circuit breaker which will then open the contact. The circuit breaker could however also be actuated manually or by using an ordinary control signal sent to the actuator 7 without detection of anomalous conditions.

Figure 2:
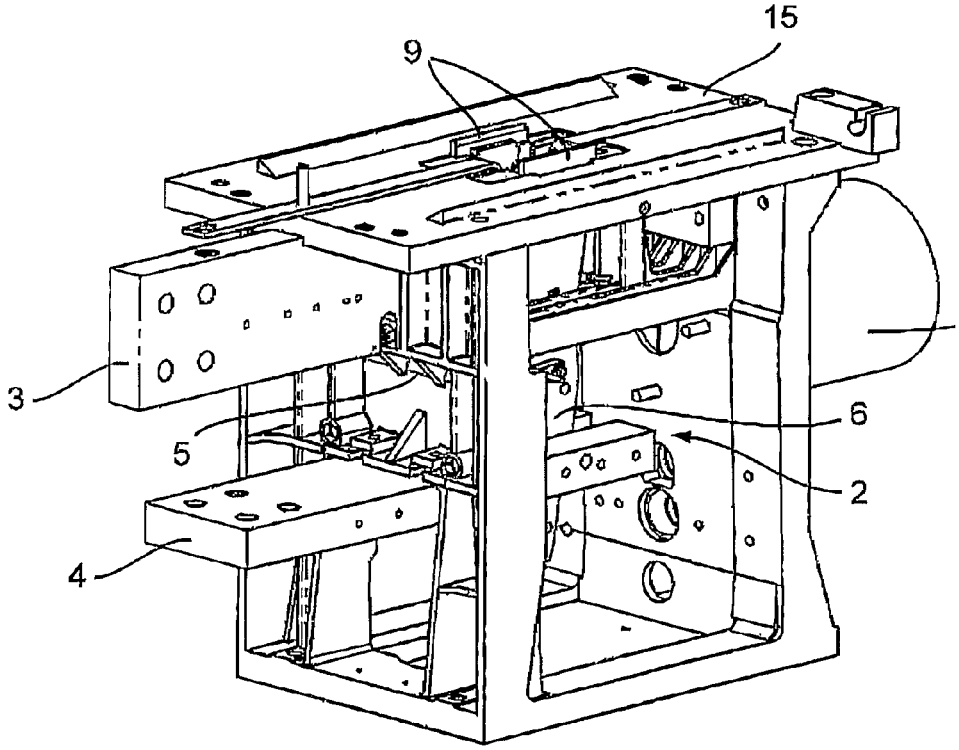
FIG. 2 shows in another view the arrangement of the blow-out device according to FIG. 1.

FIG. 2 shows in another view the arrangement of the blow-out device 2 according to FIG. 1. In this figure the arc-chute is not shown. The actuator 7 and the contact bars 3, 4 are indicated as well as two pole pieces 9 which will be described more in detail below. The upper generally flat surface 15 is the support surface for the associated arc-chute.

Figure 3:
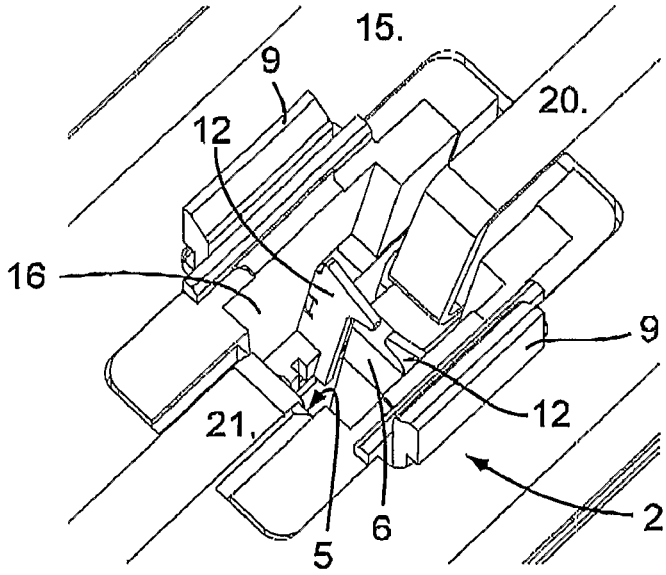
FIG. 3 shows the mechanical arrangement of the electrodes in a circuit-breaker according to the invention.

FIG. 3 shows the mechanical arrangement of the electrodes in the blow-out device 2. In an orifice 16 in the central part of a support surface 15 the two pole pieces 9 are reaching upwards in the direction of the arc-chute 1 not shown on this figure. Through this orifice 16 two electrodes 12 mounted on each side of the moving contact element 6 can also been seen. As will be described below these electrodes form an essential part of the present invention.

The blow-out device 2 comprises moreover a first guiding horn 20 mounted over the moving contact element 6 and electrically connected to the latter and a second guiding horn 21 mounted on the top of the fixed contact element 5 and electrically connected to the latter.

Figure 4:
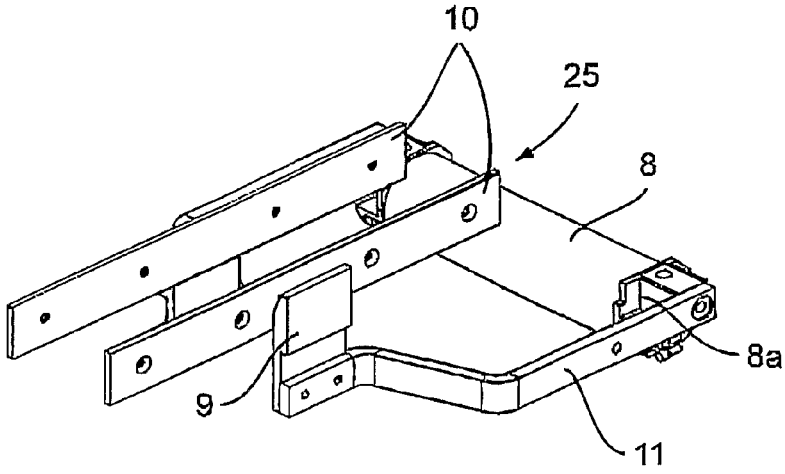
FIG. 4 shows an example of the arrangement of the magnetic circuit in said blow-out device.

FIG. 4 shows an embodiment of the arrangement of a magnetic circuit 25 in the blow-out device 2. A magnetising coil 8 is generating a magnetic field in said magnetic circuit comprising a core 8*a* and two arms 11 each terminated by a pole piece 9. In the magnetic circuit are also arranged two pole pieces 10 forming part of the arc-chute 1 which will be mounted on top of the support surface 15.

These pole pieces 10 are not fixed to the pole pieces 9 but will be arranged close to or in contact with these pole pieces 9 when the arc-chute 1 is mounted on top of the blow-out device 2. The core, arms and pole pieces of the magnetic circuit are suitably made of iron. This arrangement is also schematically shown in FIG. 5.

Figure 5:
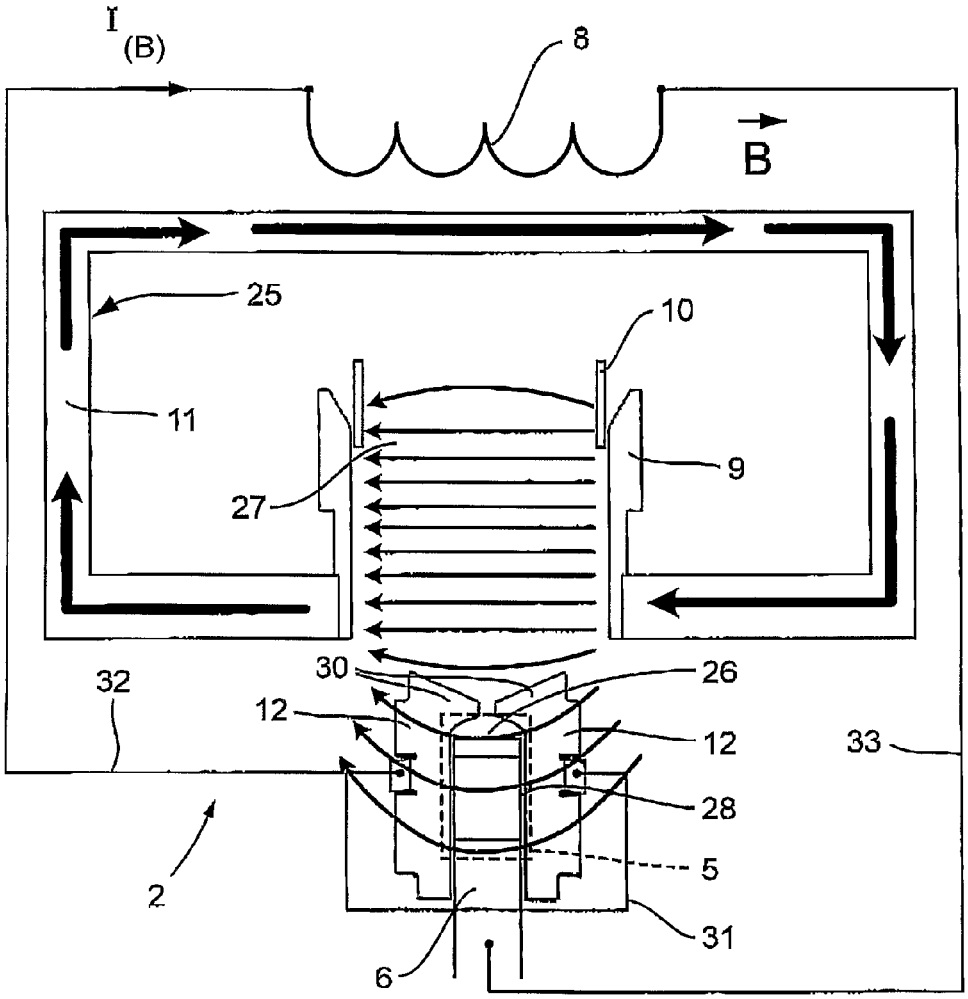
FIG. 5 shows details of the magnetic circuit in said blow-out device.

FIG. 5 shows details of the magnetic circuit 25 in the blow-out device 2. It should be noted that the FIG. 5 is schematic and is particularly intended to show the generation of the magnetic field 26 in the gap between the fixed and moving contact elements 5, 6 and in the arc-chute. When activated by a current $I_{(B)}$ the magnetising coil 8 is generating a magnetic flow through the arms 11 of the magnetic circuit and in the gap between the pole pieces 9, 10. The design and arrangement of the pole pieces 9 is such that a higher induction is achieved in the arc-chute zone 27 and a lower or even considerably lower induction 2 is generated in the zone 28 between the mobile and fixed contact elements 5, 6.

FIG. 5 shows also that the two electrodes 12 forming the electrode means are arranged in a surrounding manner around the moving contact element 6. Each of these electrodes 12 comprises in its upper part a protrusion 30 facing each other. Both electrodes 12 are electrically connected by a wire 31. They are also electrically connected by a wire 32 to the magnetising coil 8 and from the latter by a wire 33 to the moving contact element 6.

Figure 6:
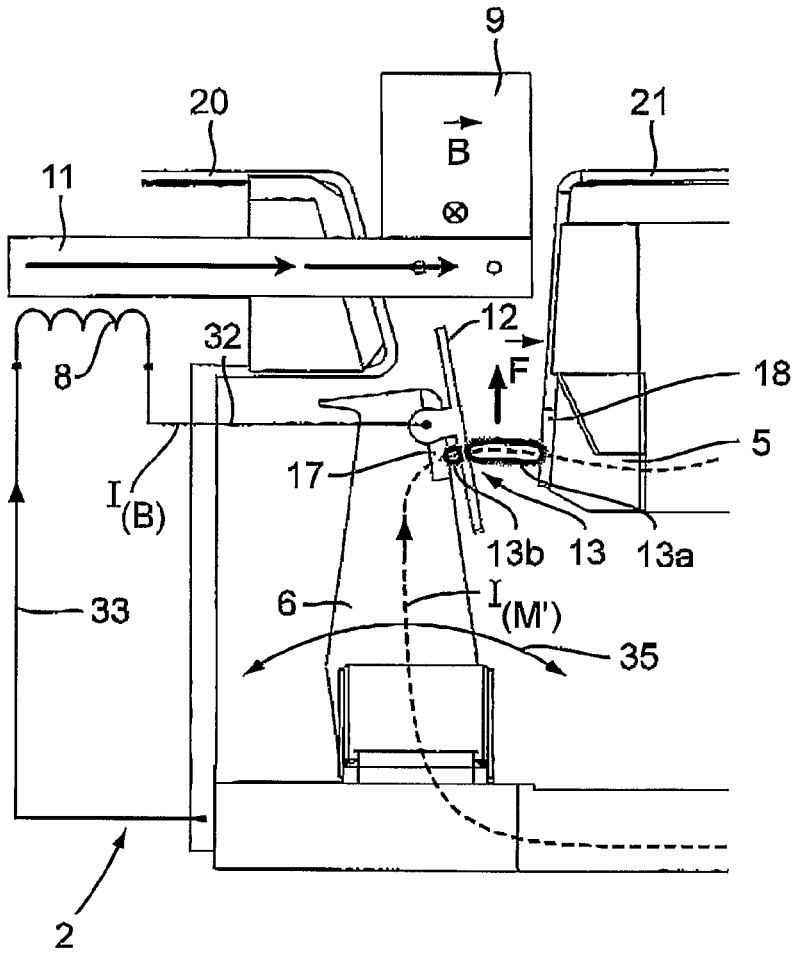
FIG. 6 shows a side view of the elements represented in FIG. 5.
Figure 7:
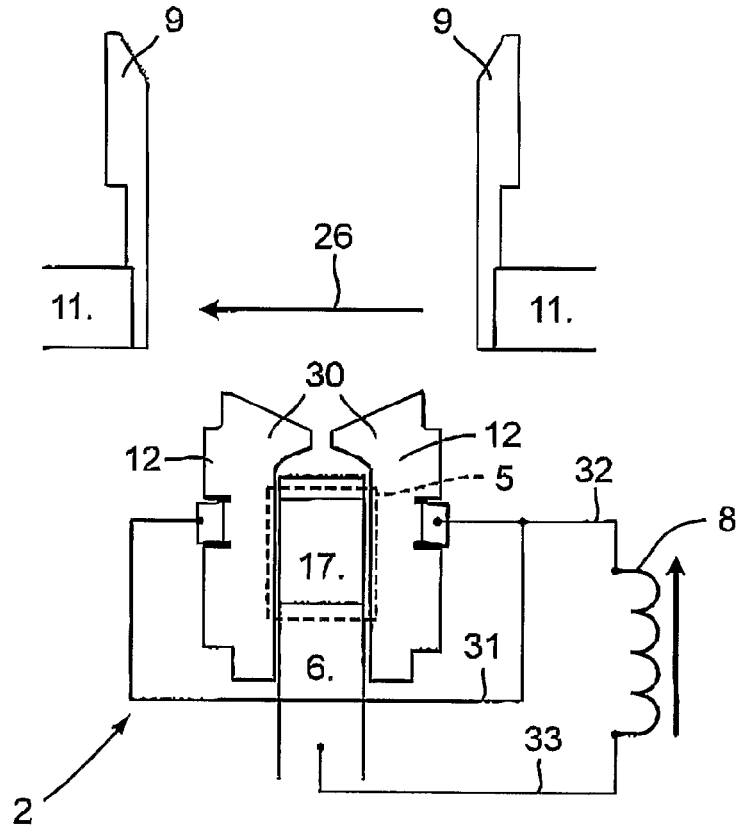
FIG. 7 shows a detailed view of some elements represented in FIG. 5.

FIG. 6 shows a side view of the arrangement of the electrodes 12 in the blow-out device 2. In a schematic form it is illustrated how the activating current $I_{(B)}$ for the magnetising coil 8 according to the above is generated automatically during the breaking sequence without the input of energy from the outside of the circuit breaker. The fixed and moving contact elements 5, 6 are shown in side view. A co-operating electrical circuit comprises the moving contact element 6, the magnetising coil 8 and the pair of electrodes 12 positioned on either side of the moving contact element 6. The arrangement of these electrodes is also shown in FIG. 7.

Under normal conditions the fixed and moving contact elements are in electrical contact carrying the full main current $I_{(M')}$. In the shown embodiment, especially in FIGS. 1 and 6, the moving contact element 6 has a pivoting movement 35. This means that under normal conditions the surfaces 17, 18 on the contact elements 6 and 5 respectively are in electrical contact.

If now some predefined conditions are detected in the main circuit which according to the applied strategy should result in a cut off of the main current, then the actuator 7 which could be of electromechanical type acting on the moving contact element 6 will receive a control signal. As a result the moving contact element 6 is withdrawn from the fixed contact element 5.

The main current $I_{(M')}$ will however not drop to zero immediately due to the fact that an electrical arc 13 is created between the fixed and the moving contact elements 5 and 6 respectively. The challenge for a circuit breaker is now to turn out this electrical arc as quick as possible in order to limit possible damages in the main circuit.

As described above, this type of circuit breaker uses an arc-chute 1 into which the electrical arc 13 is forced in order to split it up and finally extinguish it. In FIGS. 1 and 6 the arc-chute 1 is physically arranged in the upper part of the figure. A driving force F which will get the arc into the arc-chute is created by the interaction between the arc and the magnetical field 26 in the space around the contact elements 5, 6. This driving force F has then to be directed upwards in FIG. 6.

The resulting force on the arc 13 in the circuit breaker according to the present embodiment has in principle three components which will be described in the following. An additional component will be added in a variant according to FIG. 8.

Already when the arc 13 appears between the contact elements 5, 6, this arc will be exposed to a force from remanent magnetism in the steel parts around the space where the arc appears. Additionally, the arc 13 itself will create a magnetic field which will try to deflect the same. When the distance between the contact elements 5, 6 increases the arc 13 will be longer and the moving contact element 6 will reach a position in which a surface 17 of the moving contact element 6 is flush with a plane passing through the electrodes 12 arranged on both sides of the trajectory of the moving contact element 6 as shown in FIGS. 6 and 7. The arc has in reality the form of a plasma and the impact point or area on the surfaces 17 and 18 are not well defined. When the current $I_{(B)}$ is zero, which it is until now, the potential on the electrodes 12 is the same as on the surface 17. The arc or a part of it can now jump over to one of the electrodes 12 on one side of the contact element 6 which will then create one arc 13*a* between the fixed contact element 5 and the electrode 12 and a further arc 13*b* between the electrode 12 and the surface 17. The potential difference over the arc between the electrode 12 and the surface 17 will now drive a current through the magnetising coil 8. This fact is according to the invention used for creating a magnetic field in the space between the contact elements 5, 6 and the pole pieces 9, 10 which will make sure that the arc is now forced up into the arc-chute 1. It has been shown that this arrangement gives very good results for lower values on the main current as well. It should be noted that the arrangement works for both directions of the main current at the moment of breaking.

Once in the arc-chute 1 the arc has left the electrodes 12. The force to push the arc further is thus created by the remanent induction of the magnetic circuit. The higher the induction level is, the quicker the arc will be blown into the arc-chute.

As has been described in connection to FIG. 5 the magnetic flux is due to the design, much higher between the pole pieces 9 and 10 and in the arc-chute 1 than close to the contact elements 5, 6, which is of advantage.

FIG. 7 shows an example of the arrangement of the electrodes 12 in a detail view in the blow-out device 2. The electrodes 12 are closely surrounding the moving contact element 6 to make it easier for the arc 13 or at least a part of the arc to jump. Just on top of the element 6 the electrodes 13 are provided with two protrusions 30 facing each other. These parts of the electrodes will efficiently stop the arc from moving up between the electrodes without touching the same.

Figure 8:
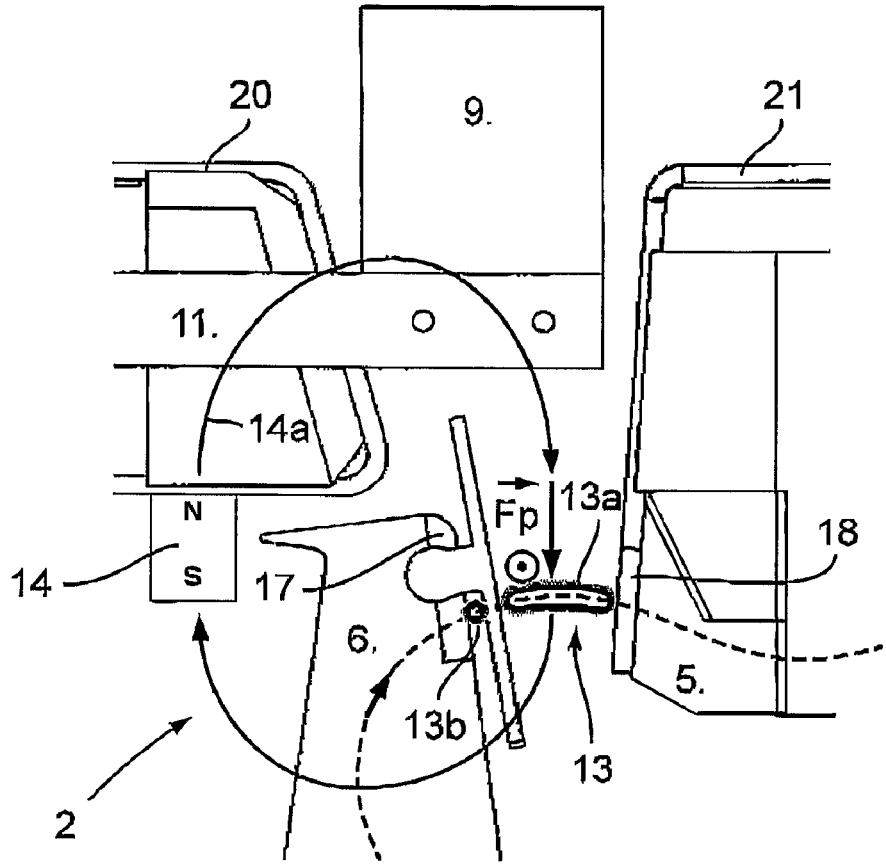
FIG. 8 shows a variant of the circuit breaker comprising a permanent magnet in the blow-out device.

FIG. 8 shows a variant of the preceding embodiment comprising an additional permanent magnet 14 in a blow-out device according to the embodiment in FIG. 6. This permanent magnet 14 creates an additional magnetic flux 14*a* in the arcing zone in the space between the contact elements 5, 6. This flux will create a force Fp on the arc 13 already from the start which is not directly contributing to the arc movement up into the arc-chute. The force will be directed perpendicular to the plane of the paper and will thus force the arc to contact laterally one of the electrodes 12 at an early stage.

FIGS. 9A, 9B, 9C and 9D show schematically the arc formation when breaking the current $I_{(M')}$ between the fixed and moving contact elements 5, 6 in four different positions.

Figure 9A:
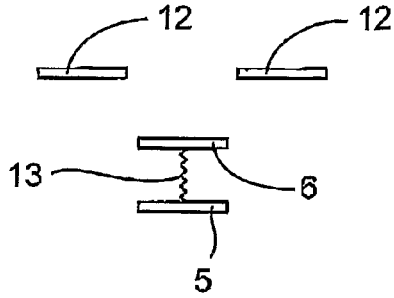
FIGS. 9A, 9B, 9C and 9D show schematically the arc formation in a circuit breaker according to the invention.

In FIG. 9A the arc 13 appears between the contact elements 5, 6 and the current ($I_{(M')}$) is driven through said arc.

Figure 9B:
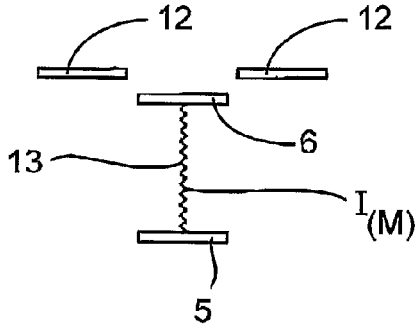

In FIG. 9B the arc 13 gets longer as the moving contact element 6 approaches the electrodes 12.

Figure 9C:
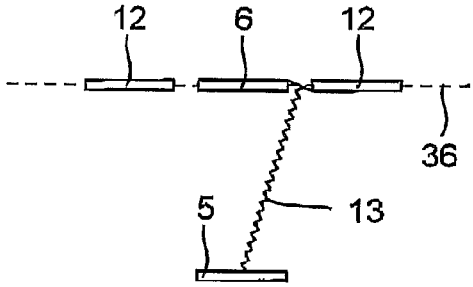

In FIG. 9C the moving contact element 6 is contained in a plane 36 passing through the electrodes 12. The arc 13 or a part of said is now jumping over laterally to one of the electrodes 12.

Figure 9D:
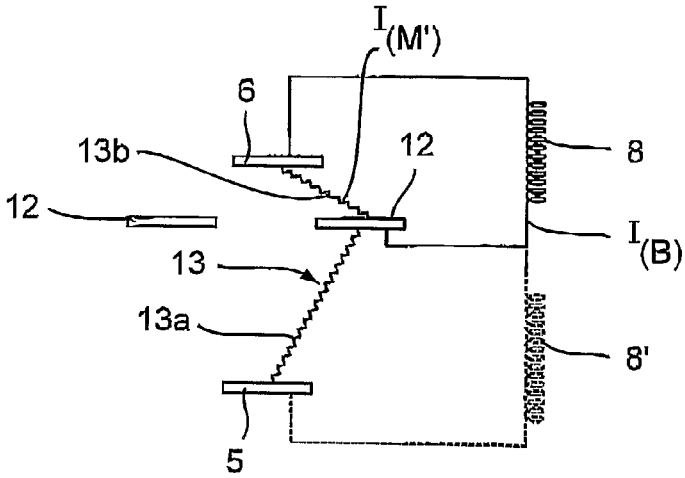

Finally, in FIG. 9D the arc or a part of it is split up in a first arc 13*a* between the fixed contact element 5 and one of the electrodes 12 and a second arc 13*b* between the electrode 12 and the moving contact element 6.

One part of the current $I_{(M')}$ is established between the electrode 12 and the moving contact element 6 through the channel of the second arc 13*b*. Another part of the current $I_{(B)}$ will pass from the electrode 12 to moving contact 6 by being driven through the coil 8 and generating the magnetic field 26.

The current $I_{(B)}$ passing through the coil 8 has a much smaller value, than the current $I_{(M')}$ passing through arc 13*b*. Typically $I_{(B)}$ may have values of 10 to 50 A and $I_{(M')}$ values between 1000 and 200'000 A. $I_{(B)}$ is thus preferable at least three times smaller than $I_{(M')}$.

The resistance of the arc 13*b* is much lower than the resistance of coil 8. Said coil 8 is set in parallel coupling with arc 13*b*.

Due to this particular arrangement of the electrodes 12 and of the moving and fixed contact elements the advantage of a parallel coupling of the arc or a part of the arc and the coil 8 is obtained. It is thus possible to provide the blow out device with a coil 8 having a considerable number of turns, which permits to generate an elevated magnetical field 26. The efficiency of the blow out device is thus much higher when compared to known blow out devices in which all the current flows through the coil. In said known devices the coil can thus only have a very limited number of turns. Therefore, a very limited blow out efficiency can be obtained in the known devices.

Moreover, in the present invention the coil is not subject to high currents and the device has therefore a much better longevity and a lower cost price compared to known devices.

As shown in FIGS. 5 to 9, the electrodes 12 are located in such a relationship with the contact elements 5, 6, that the arc generated by the separation of the two contact elements is at least partially separated into a first arc 13*a* between one of the contact elements, here the fixed contact element 5, and the electrodes 12 and a second arc 13*b* between the electrodes 12 and the other contact element, here the moving contact element 6. The second or the first arc 13*b* or 13*a* are set in parallel coupling with the magnetising coil 8 which is connected on one side to the electrodes 12 and on the other side to one of the contact elements 5 or 6, here the moving contact element 6. In particular these features allow to obtain the above-mentioned advantages.

Of course, the embodiment described above is in no way limiting and can be the subject of all desirable modifications within the framework defined by the claims.

The coil 8 could be connected between the electrodes 12 and the fixed contact element 5 as shown in dotted lines in FIG. 9D.

The electrodes 12 could have a very different shape. Only one electrode could be provided as electrode means. This single electrode could be mounted in a surrounding manner around the moving contact element 5.

The circuit breaker could be provided with more than one moving and fixed contact element.

The design of the magnetic circuit 25, of the arms 11 and of the pole pieces 9 and 10 could be chosen differently.

The blow out device 2 could be provided with more than one coil, the latter being however set in parallel coupling with the arc or part of the arc.

The invention claimed is:

1. Electromechanical circuit breaker intended to establish and break the current in a main circuit (3, 4) and comprising a fixed contact element (5) and a moving contact element (6) which in a first position are in electrical contact with each other for carrying the current of the main circuit (3, 4), said moving contact element (6) being adapted to be displaced to a second position in which it is separated from the fixed contact element (5) so that the current in the main circuit is cut off, the circuit breaker being provided with a blow-out device (2) comprising a magnetising coil (8) traversed by a magnetising current for producing a magnetic field (26) adapted to drive an arc generated by the separation of said two contact elements (5, 6) into an arc extinction means (1), the blow-out device (2) comprising electrode means (12) electrically connected to the magnetising coil (8) and adapted to cooperate with said arc in such a manner that the latter generates said magnetising current in the magnetising coil (8), the magnetic field for driving the arc being generated by the action of said arc, characterized by the fact that said electrode means (12) are located in such a relationship with said contact elements (5, 6) that the arc generated by the separation of said two contact elements is at least partially separated into a first arc (13*a*) between one contact element (5) and the electrode means (12) and a second arc (13*b*) between the electrode means (12) and the other contact element (6), said first or second arc (13*a*, 13*b*) being set in parallel coupling with said magnetising coil (8) connected on one side to the electrode means (12) and on the other side to one of the contact elements (5, 6).

2. Current breaker according to claim 1, characterized by the fact that the blow-out device is arranged in such a manner that current (I<B>) passing in the magnetising coil (8) is smaller than the current (I(M−)) passing in the first or second arc (13*a*, 13*b*) set in parallel coupling with the magnetizing coil (8) between the electrode means (12) and the one of said contact elements (5, 6).

3. Circuit breaker according to claim 2, characterized by the fact that the electrode means comprises one or two electrodes (12) mounted on both sides of the moving contact element (6) so as to surround the latter.

4. Circuit breaker according to claim 3, characterized by the fact that the moving contact element (6) comprises a surface (17) which is, in a predetermined position of the moving contact element (6), flush with a plane passing through the electrode(s) (12) arranged on both sides of the trajectory of the moving contact element (6) such that at least a part of the arc (13) can jump over to the electrode(s) (12) to form said first arc (13*a*) and from the electrode(s) (12) to the movable contact element (6) to form said second arc (13*b*).

5. Current breaker according to claim 3, characterized by the fact that the electrode means comprises two electrodes (12) mounted on both sides of the moving contact element (6) and provided both with a protrusion (30) facing each other, said protrusions (30) being shaped so as to catch the arc.

6. Current breaker according to claim 1, characterized by the fact that the blow-out device (2) is provided with a magnetising IS circuit (25) comprising at least two arms (11) each terminated by at least one pole piece (9), said magnetic field (26) for driving the arc being generated at least partially between said pole pieces (9).

7. Current breaker according to claim 6, characterized by the fact that the extinction means is an arc-chute (1) mounted on the blow-out device (2), this arc-chute (1) being provided on its side near the blow-out device (2) with two supplementary pole pieces (10) arranged close to or in contact with said pole pieces (9).

8. Current breaker according to claim 6, characterized by the fact that the design and the arrangement of the pole pieces (9, 10) is such that a higher induction is achieved in the zone of the arc extinction means (1), and lower induction is achieved in the zone between the moving and fixed contact elements (5, 6).

9. Current breaker according to claim 1, characterized by the fact that the blow-out device (2) is provided with at least one permanent magnet (14) adapted to generated a force on the arc in order to displace the latter so that the arc is forced to contact the electrode means (12).

10. Circuit breaker according to claim 1, characterized by the fact that it is provided with detection means for detecting predetermined conditions in the main circuit under which the main current has to be cut off, said detection means cooperating with an actuator (7) adapted to displace the moving contact element (6) so as to cut of said main current.

11. Current breaker according to claim 7, characterized by the fact that the design and the arrangement of the pole pieces (9, 10) is such that a higher induction is achieved in the zone of the arc extinction means (1), and lower induction is achieved in the zone between the moving and fixed contact elements (5, 6).

12. Method of breaking the current in an electromechanical circuit breaker intended to break the current in a main circuit (3, 4) and comprising a fixed contact element (5) and a moving contact element (6) which in a first position are in electrical contact with each other for carrying the current of the main circuit (3, 4), said moving contact element (6) being adapted to be displaced to a second position in which it is separated from the fixed contact element (5) so that the current in the main circuit is cut off, an arc generated by the separation of said two contact elements (5, 6) being driven into arc extinction means (1) by a blow-out device (2) comprising a magnetising coil (8) traversed by a magnetising current for producing a magnetic field (26) adapted to drive said arc, the magnetic field for driving the arc being generated by the action of the arc, the latter being forced to cooperate with electrode means (12) electrically connected to the magnetising coil (8) so as to generate said magnetising current in the magnetising coil (8) for driving the arc into the arc extinction means (1), characterized by the fact that the arc generated by the separation of said two contact elements (5, 6) is at least partially separated into a first arc (13*a*) between one contact element (5) and the electrode means (12) and a second arc (13*b*) between the electrode means (12) and the other contact element (6), said first or second arc (13*a*, 13*b*) being set in parallel coupling with said magnetising coil (8) connected on one side to the electrode means (12) and on the other side to one of the contact elements (5, 6).

13. Method according to claim 12, characterized by the fact that the current (I (B)) passing in the magnetising coil (8) is smaller than the current (I (M')) passing in the first or second arc (13*a*, 13*b*) set in parallel coupling with the magnetising coil (8) between the electrode means (12) and the one of said contact elements (5, 6).

14. Method according to claim 13, characterized by the fact that one provides one or two electrodes (12) forming said electrode means on both sides of the moving contact element (6) so as to surround the latter.

15. Method according to claim 14, characterized by the fact that one arranges the moving contact element (6) in such a manner that a surface (17) thereof is, in a predetermined position of the moving contact element (6), flush with a plane passing through the electrode(s) (12) arranged on both sides of the trajectory of the moving contact element (6) such that at least a part of the arc (13) can jump over to the electrode(s) (12) to form said first arc (13*a*) and from the electrode(s) (12) to the moving contact element (6) to form said second arc (13*b*).

16. Method according to claim 14, characterized by the fact that the electrode means are shaped such as to form two electrodes (12) mounted on both sides of the moving contact element (6) and provided both with a protrusion (30) facing each other, said protrusions (30) being shaped so as to catch the arc.

17. Method according to claim 12, characterized by the fact that the magnetic field generated in the magnetising coil is conducted by a magnetising circuit comprising at least two arms (11) each terminated by at least one pole piece (9) to a predetermined location adapted for driving the arc into the arc extension means (1).

18. Method according to claim 17, characterized by the fact that the design and the arrangement of the pole pieces is chosen in such a manner that a higher induction is achieved in the zone of the arc extinction means (2), and lower induction is achieved in the zone between the mobile and fixed contact elements (5, 6).

19. Method according to claim 12, characterized by the fact that at least one permanent magnet (14) is mounted in the blow-out device and adapted to generate a force on the arc in order to displace the latter so that the arc is forced to contact the electrode means (12).

20. Method according to one claim 13, characterized by the fact that the magnetic field generated in the magnetising coil is conducted by a magnetising circuit comprising at least two arms (11) each terminated by at least one pole piece (9) to a predetermined location adapted for driving the arc into the arc extension means (1).

* * * * *